US012215713B2

(12) United States Patent
Maurer

(10) Patent No.: US 12,215,713 B2
(45) Date of Patent: Feb. 4, 2025

(54) ELECTRIC-MOTOR RADIATOR FAN OF A MOTOR VEHICLE

(71) Applicant: Brose Fahrzeugteile SE & Co. Kommanditgesellschaft, Wuerzburg, Wuerzburg (DE)

(72) Inventor: Bernd Maurer, Bad Zwischenahn (DE)

(73) Assignee: BROSE Fahrzeugteile SE & Co. Kommanditgesellschaft, Wuerzburg, Wuerzburg (DE)

( * ) Notice: Subject to any disclaimer, the term of this patent is extended or adjusted under 35 U.S.C. 154(b) by 198 days.

(21) Appl. No.: 17/631,942

(22) PCT Filed: Jul. 29, 2020

(86) PCT No.: PCT/EP2020/071423
§ 371 (c)(1),
(2) Date: Mar. 16, 2022

(87) PCT Pub. No.: WO2021/018976
PCT Pub. Date: Feb. 4, 2021

(65) Prior Publication Data

US 2022/0275812 A1 Sep. 1, 2022

(30) Foreign Application Priority Data

Aug. 1, 2019 (DE) ..... 10 2019 211 507.1

(51) Int. Cl.
*F04D 29/58* (2006.01)
*F04D 25/06* (2006.01)
(Continued)

(52) U.S. Cl.
CPC ..... *F04D 29/5853* (2013.01); *F04D 25/06* (2013.01); *F04D 29/541* (2013.01); *F04D 29/644* (2013.01)

(58) Field of Classification Search
CPC .. F04D 25/06; F04D 29/5806; F04D 29/5813; F04D 29/541; F04D 29/644; F04D 29/646; F04D 29/40–566
See application file for complete search history.

(56) References Cited

U.S. PATENT DOCUMENTS 3,790,114 A * 2/1974 Italiano ..... H02K 5/00 248/675
5,117,656 A * 6/1992 Keck ..... F24F 1/50 62/506

(Continued)

FOREIGN PATENT DOCUMENTS

DE 102014010696 A1 1/2016
DE 112015003043 T5 6/2017

(Continued)

*Primary Examiner* — Philip E Stimpert
(74) *Attorney, Agent, or Firm* — Laurence A. Greenberg; Werner H. Stemer; Ralph E. Locher

(57) ABSTRACT

An electric-motor radiator fan of a motor vehicle has a fan shroud with a motor holder. An electric motor is inserted in the motor holder. A heat shield plate is arranged on the end side of the electric motor. The heat shield plate is placed onto a projection of the motor holder by way of a cut-out, and the heat shield plate is pivoted around the projection, which forms an axis of rotation, in such a way that the heat shield plate is forced at least in sections into at least one holding contour of the motor holder in a positive locking and/or friction-locking manner.

10 Claims, 4 Drawing Sheets

(51) Int. Cl.
*F04D 29/54* (2006.01)
*F04D 29/64* (2006.01)

(56) References Cited

U.S. PATENT DOCUMENTS

| | | | | |
|---|---|---|---|---|
| 5,180,279 | A | 1/1993 | McLane-Goetz et al. | |
| 6,674,198 | B2 * | 1/2004 | Gubbels | H02K 5/165 310/90 |
| 8,057,167 | B2 | 11/2011 | Suzuki et al. | |
| 10,337,530 | B2 * | 7/2019 | King | F04D 29/703 |
| 2010/0158713 | A1 | 6/2010 | Suzuki et al. | |

FOREIGN PATENT DOCUMENTS

| | | | |
|---|---|---|---|
| KR | 20140083718 | A | 7/2014 |
| WO | 2019054140 | A1 | 3/2019 |

* cited by examiner

ELECTRIC-MOTOR RADIATOR FAN OF A MOTOR VEHICLE

FIELD AND BACKGROUND OF THE INVENTION

The invention relates to an electric-motor radiator fan of a motor vehicle, having a fan shroud with a motor holder, and an electric motor inserted into the motor holder, and also a heat protection plate arranged on the end side of the electric motor. The invention further relates to a heat protection plate for such a radiator fan.

Motor vehicles having an internal combustion engine generate a considerable amount of heat during operation. To maintain the operating temperature, or within an air-conditioning system, use is typically made of a coolant, which in turn has to be cooled. This usually occurs in that cooling air sweeps over cooling fins which are in thermal equilibrium with the coolant. Since it is in particular the case at low driving speeds that the relative wind is normally not sufficient for cooling, it is possible for example for the radiator comprising the cooling fins to have fastened thereto a radiator fan with a fan shroud and with an electric (electric-motor) drive which generates an additional air flow which is guided by the shroud body. For this purpose, the (fan) drive has an electric motor which is drivingly coupled to a drive part, in particular to a fan wheel generating the air flow.

It is customarily the case that the shroud body has a substantially round cutout within which the fan drive is arranged. Here, the plane in which the fan wheel is situated is substantially parallel to the plane of the cooling fins. The motor drivingly coupled to the fan wheel is usually fixed on the end side to a rigid motor holder by means of screws or rivets, with the (motor) holder being held in the center of the cutout by means of radially extending struts.

For example, use is made of brushless electric motors in which a rotor mounted rotatably with respect to a stator is driven by a magnetic rotary field. Here, phase windings of the rotor (rotary field winding) are acted upon by a corresponding electric three-phase current or motor current which is controlled and regulated by means of a controller as part of (motor) electronics.

In a typical installation situation, the radiator fan or the electric motor is frequently arranged in the surroundings of further heat-generating components of the internal combustion engine, such as an exhaust-gas manifold, for example. In order to protect the electric motor and in particular the motor electronics, there are regularly provided here so-called heat protection plates as heat shield or as heat protection.

Such heat protection plates are designed, for example, in the form of a hood or cover and are arranged on an end side of the electric motor that faces the heat-generating components. In other words, the end side of the electric motor is completely or at least partially covered or concealed by the associated heat protection plate, with the heat protection plate expediently being arranged so as to be thermally insulated from the electric motor.

To fasten the heat protection plate, it is, for example, customary for the heat protection plate to be joined to the motor holder in a force-fitting manner by means of a three-point screw connection, that is to say by means of three fastening screws arranged in a distributed manner. However, on account of the triple screw connection, such heat protection plates have a comparatively high mounting complexity.

To fasten the heat protection plate to the motor holder, it is, for example, also possible to configure the heat protection plate with two lugs which are plugged into corresponding receptacles of the motor holder in a form-fitting manner, with the heat protection plate being fixed to the motor holder in a mechanically secure manner by means of a fastening screw. A disadvantage is that the heat protection plate is not held fixedly in the receptacles here. In other words, the lugs are seated substantially loosely in the receptacles, with the result that, given the only single screw fastening, such heat protection plates frequently rattle when subjected to oscillations or vibrations occurring during the operation of the radiator fan. Undesired noise is generated as a result.

U.S. Pat. No. 6,674,198 B2 describes an electric-motor radiator fan having an electric motor and a heat protection plate arranged on the end side thereof. Here, the heat protection plate has tangential cutouts arranged in a distributed manner on its edge or circumference. For mounting purposes, the heat protection plate is placed by way of the cutouts onto axially projecting lugs of the electric motor which, for example, form a form-fitting latching or clipping connection with the cutouts. This means that the heat protection plate is directly joined to the electric motor. On account of production-related tolerances, however, the lugs in the cutouts always have a certain remaining degree of play, as a result of which the heat protection plate generates undesired noise when exposed to vibrations. Furthermore, the heat shielding and thus the heat protection of the electric motor is impaired by the heat protection plate being directly attached to the electric motor.

DE 11 2015 003 043 T5 discloses an electric-motor radiator fan having a heat protection plate, in which a cover of a motor housing of the electric motor has a number of axially projecting joining domes. The heat protection plate has a corresponding number of guide-through openings for receiving the joining domes. Here, the diameter of the guide-through openings is dimensioned to be smaller than the diameter of the joining domes such that, when placing the heat shield, there occurs a press fit between the heat shield and the joining domes. The press fit disadvantageously makes it more difficult to demount the heat shield in the case of a service, for example for maintenance or for repair.

SUMMARY OF THE INVENTION

The object on which the invention is based is to specify a particularly suitable electric-motor radiator fan of a motor vehicle. It is intended in particular for a heat protection plate to be able to be mounted with the least possible complexity and in the simplest possible manner. Furthermore, it is intended that, during operation of the radiator fan, the heat protection plate is held such that it produces the lowest possible noise or its noise is reduced as far as possible. Another object on which the invention is based is to specify a heat protection plate for such a radiator fan.

With regard to the radiator fan, the object is achieved according to the invention by the features as claimed, and with regard to the heat protection plate, the object is achieved according to the invention by the features as claimed. Advantageous embodiments and developments form the subject matter of the dependent claims. The advantages and embodiments specified with respect to the radiator fan can, mutatis mutandis, also be transposed to the heat protection plate, and vice versa.

The electric-motor or electric radiator fan according to the invention is suitable and designed for a motor vehicle. Here, the radiator fan has a fan shroud with a motor holder (motor support) or with a motor mount. Here, the fan shroud has, for example, a circular cutout in which the, for example annular, motor holder is held with a number of approximately radially extending struts. An electric motor is inserted in the motor holder and held therein. On the end side of the electric motor there is arranged a heat protection plate as heat shield which completely or at least partially covers or conceals the end side. Here, the heat protection plate is in particular arranged on an end side facing the fan shroud, that is to say an end side of the electric motor situated opposite to a fan wheel.

According to the invention, the heat protection plate here has a cutout by means of which the heat protection plate is placed on an axially protruding projection of the motor holder that, for example, takes the form of a pin, stud or dome. For mounting purposes, the heat protection plate is pivoted or rotated about the projection as an axis of rotation in such a way that the heat protection plate is screwed, at least in certain portions, into at least one holding contour of the motor holder in a form-fitting and/or force-fitting manner. A particularly suitable radiator fan is realized as a result.

The conjunction "and/or" is to be understood here and below to mean that the features linked by means of this conjunction can be formed either jointly or as alternatives to one another.

A "form fit" or a "form-fitting connection" between at least two interconnected parts is to be understood here and below in particular as meaning that the interconnected parts are held together at least in one direction by a direct inter-engagement of contours of the parts themselves or by an indirect inter-engagement via an additional connecting part. The "blocking" of a reciprocal movement in this direction thus occurs in a shape-conditioned manner.

A "force fit" or a "force-fitting connection" between at least two interconnected parts is understood here and below to mean in particular that the interconnected parts are prevented from sliding on one another as a result of a frictional force acting between them. In the absence of a "connecting force" producing this frictional force (this means that force which presses the parts against one another, for example a screw force or the weight force itself), the force-fitting connection cannot be maintained and can thus be released.

"Axial" or an "axial direction" is to be understood here and below to mean in particular a direction parallel (coaxial) to the axis of rotation of the electric motor, that is to say perpendicular to the end sides of the radiator fan. Correspondingly, "radial" or a "radial direction" is to be understood here and below as meaning in particular a direction, which is oriented perpendicular (transversely) to the axis of rotation of the electric motor, along a radius of the radiator fan or of the electric motor. "Tangential" or a "tangential direction" is to be understood here and below as meaning in particular a direction along the circumference of the radiator fan or of the electric motor (circumferential direction, azimuthal direction), that is to say a direction perpendicular to the axial direction and to the radial direction.

According to the invention, the heat protection plate is placed or plugged onto the axial projection of the motor holder by means of the cutout. The projection of the motor holder is thus at least partially seated in the cutout of the heat protection plate. As a result, the heat protection plate is held on the projection in a form-fitting manner along the radial direction and the tangential direction. The projection is arranged in particular on an inner circumference or an inner edge of the, in particular annular, motor holder.

During rotation or during pivoting about the projection, the heat protection plate is screwed into at least one holding contour of the motor support, wherein, in the screwed-in state, the form fit and/or force fit fixes the heat protection plate in particular along the axial direction and/or the tangential direction.

The form fit and/or force fit between the at least one holding contour and the heat protection plate is preferably reversibly releasable, in particular releasable manually or by hand, thereby making it possible in a particularly simple manner to loosen/release the form fit and/or force fit, for example in the case of a service.

This ensures that the heat protection shield is mounted on the motor holder with particularly reduced complexity and in a particularly simple manner. As a result of the fastening of the heat protection plate to the motor holder, there is preferably no direct physical or thermal contact between the heat protection shield and the electric motor, such that particularly effective and reliable heat shielding or heat protection is realized.

Here, the motor holder is expediently a plastic part, in particular an injection-molded part having a comparatively low thermal conductivity. The heat protection plate is, for example, a sheet metal part, in particular a stamped and bent part, having a comparatively high thermal conductivity. The heat protection plate is, for example, configured as a thin, approximately circular disk. This means that the heat protection plate has a diameter which is substantially greater than its axial height.

In an advantageous embodiment, the form fit and/or force fit is configured in the manner of a bayonet connection. This makes it possible to mount the heat protection shield in a particularly simple manner and with particularly reduced complexity.

In a preferred development, the heat protection plate is mechanically prestressed in the screwed-in state (mounted state). The mechanical prestressing ensures particularly vibration-free or rattle-free fastening of the heat protection plate to the motor holder. As a result, the radiator fan has particularly low noise generation during operation.

In one conceivable embodiment, in the screwed-in state, the heat protection plate is fixed to the motor support in a force-fitting manner by means of only one screw connection. In other words, the screwed-in heat protection plate is secured by means of one fastening screw.

The in particular axially directed fastening screw prevents undesired release of the heat protection plate from the at least one holding contour. An axially directed force fit is realized by the (axial) screw connection. Furthermore, the heat protection plate is held in a form-fitting manner in the radial direction and tangential direction by means of the fastening screw. There is thus realized a particularly stable and operationally reliable fastening of the heat protection plate.

By contrast with the prior art, the heat protection plate is fixed only with one fastening screw so as to ensure lower mounting complexity. Preferably, the number of screws for mounting the heat protection plate is reduced as far as possible.

In an alternative embodiment, it is, for example, possible that, instead of a force-fitting screw connection, there is provided a form-fitting and/or force-fitting latching or clip connection or an integrally bonded connection, for example by means of welding. As a result, it is possible to fix the heat protection plate to the motor support in a screwless or screw-free manner, or at least to reduce the required number of screws.

In an expedient embodiment, the at least one holding contour is configured approximately in the form of a hook. The holding contour is here arranged in a tangentially oriented manner in particular on an outer circumference of the motor support. The holding contour thus has approximately a C shape or U shape in cross section, with the opening being oriented toward the screw-in direction of the heat protection plate. A particularly expedient holding contour is realized as a result.

In a particularly suitable development, the at least one holding contour is provided with a ramp guide. The ramp guide is designed here in such a way that, when screwing in, the heat protection plate slides, at least in certain portions, axially on said guide to produce inner mechanical prestressing. This means that the ramp guide is designed as an axial slope, that is to say as a surface inclined at an angle with respect to the axial direction. Here, the ramp guide has, with respect to the heat protection plate, a downward axial profile, that is to say oriented away therefrom.

When screwing in, the heat protection plate is guided, at least in certain portions, onto the ramp guide and, during further pivoting or rotation/turning, guided along the latter. As a result, the heat protection plate slides along or on the ramp guide, whereby the heat protection plate is axially braced in certain portions. Here, the heat protection plate expediently has at least a certain degree of bending flexibility such that the heat protection plate is held clamped or jammed in the holding contour by means of the ramp guide on account of the prestressing produced thereby.

There is thus realized a particularly simple and reduced-complexity fastening of the heat protection plate that simultaneously produces reliable mechanical prestressing. This makes possible a heat protection plate which is always held in a vibration- or rattle-free manner.

In one conceivable embodiment, the heat protection plate has at least one radially directed and axially angled lug. By virtue of the axial angling, the lug here forms an approximately step-shaped shoulder or offset, with the free end of this shoulder being configured as a bearing or support surface on the motor holder. A particularly simple retention or fastening on the motor holder is made possible as a result.

In an advantageous development, the at least one lug has on its free end a radially projecting lug extension which, in the screwed-in state of the heat protection plate, is screwed in the holding contour in a form-fitting and/or force-fitting manner. In other words, the lug extension of the lug engages in the holding contour of the motor holder. A particularly expedient heat protection plate is formed as a result.

An additional or further aspect of the invention provides that the heat protection plate is configured with three lugs arranged in a circumferentially distributed manner. Here, the first lug is provided with the cutout for the projection acting as an axis of rotation. In other words, the first lug is designed substantially as a pivot point of the heat protection plate in the course of mounting. The second lug, which follows along the screwing-in or pivoting direction, is provided with a screw opening, that is to say a guide-through opening for at least partially guiding through a fastening screw. This means that the second lug is designed in particular for the force-fitting screw fastening of the heat protection plate to the motor holder. The third lug, which follows along the screwing-in or pivoting direction, has on the free end side a radial lug extension which, in the screwed-in state, is seated in the holding contour in a form-fitting and/or force-fitting manner. Particularly simple and reduced-complexity mounting of the heat protection plate is ensured as a result.

To fasten or mount the heat protection plate, the first lug is placed with the cutout onto the axial projection of the motor holder. The heat protection plate is then pivoted about this pivot point or this axis of rotation until the extension of the third lug is guided into the holding contour and fixed there in particular in the manner of a bayonet connection. The heat protection plate is then screw-fastened to the motor holder in a force-fitting manner by means of the second lug.

The first lug is thus held along the radial direction and the tangential direction in a form-fitting manner, wherein the second lug is held in a force-fitting manner along the axial direction and in a form-fitting manner along the radial direction and tangential direction, and wherein the third lug is in particular held in a form-fitting and/or force-fitting manner along the axial direction and tangential direction. The heat protection plate is thus joined to the motor holder at three points or positions, with the result that particularly stable and operationally reliable fastening is realized.

The heat protection plate according to the invention is suitable and designed for an above-described radiator fan.

BRIEF DESCRIPTION OF THE FIGURES

The invention is explained in more detail below by way of a drawing, in which.

Mutually corresponding parts and sizes are always provided with the same reference signs in all of the figures.

DESCRIPTION OF THE INVENTION

Figure 1:
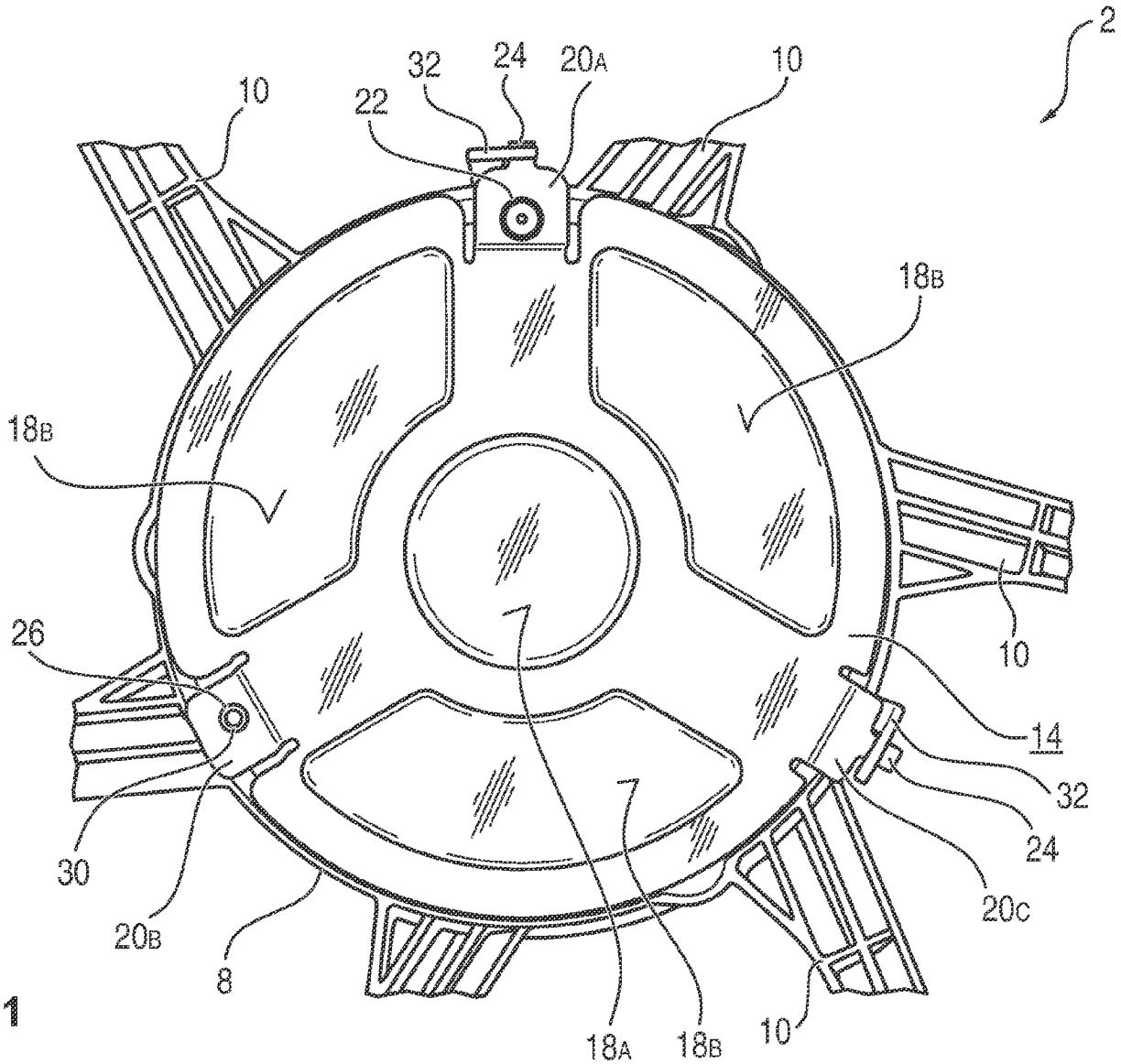
FIG. 1 is a plan view showing a detail of a radiator fan with a view of a heat protection plate fastened to a motor holder.

FIG. 1 shows a detail of an electric-motor radiator fan 2 of a motor vehicle (not shown more specifically). The radiator fan 2 has a fan shroud 4 (FIG. 2) with a central cutout in which an electric motor 6 (FIG. 3) is centrally supported by means of an annular motor holder 8 (motor ring).

The motor holder 8 is held in the cutout by means of six struts 10 arranged in a circumferentially distributed manner. The struts 10 are provided with reference signs in the figures only by way of example. The motor holder 8 and the struts 10 and also the fan shroud 4 are preferably configured integrally, that is to say in one piece or monolithically, for example as a common injection-molded part.

Figure 3:
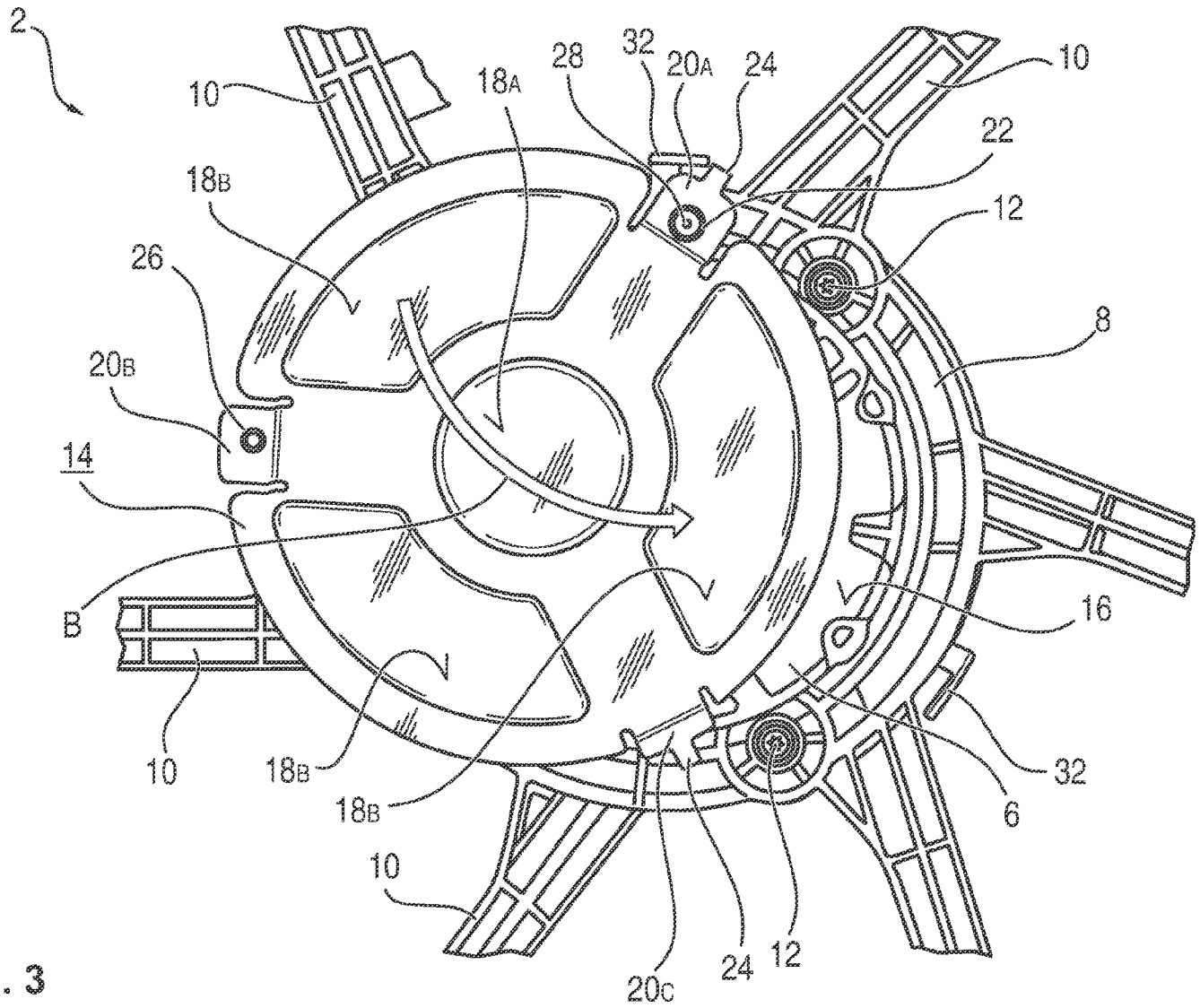
FIG. 3 is a plan view showing the radiator fan when mounting the heat protection plate.

The electric motor 6 is—as can be seen for example in FIG. 3—mechanically fixedly joined to the motor holder 8 by means of three circumferentially distributed fastening screws 12. As heat protection of the electric motor 6 there is provided a heat protection plate 14 as heat shield in the form of a cover or hood that is arranged on an end side 16 of the electric motor 6.

The heat protection plate 14 has an approximately circular shape which substantially completely conceals the end side 16. The heat protection plate 14 is configured, for example, as a stamped and bent metal part. The heat protection plate 14 has, as can be seen in particular in FIG. 2, a cambering or curvature approximately in the form of an impeller wheel, that is to say a deformation or depression 18*a*, 18*b*, for improving the stability, which is drawn in axially in the direction of the electric motor 6. Here, the cambering has a central circular depression 18*a* and three approximately wing-shaped, elongate depressions 18*b* which are arranged in a circumferentially distributed manner around said depression along the tangential direction.

A lug 20*a*, 20*b*, 20*c* of the heat protection plate 14 is in each case integrally formed between the depressions 18*b*. The lugs 20*a*, 20*b*, 20*c* have a step-shaped shoulder or offset along the axial direction A in the direction of the electric motor 6. In other words, the lugs 20*a*, 20*b*, 20*c* are bent out of the plane of the heat protection plate 14 so as to be axially angled toward the electric motor 6, with the result that the lugs 20*a*, 20*b*, 20*c* project from the heat protection plate 14 axially in the direction of the electric motor 6. The lugs 20*a*, 20*b*, 20*c* are arranged uniformly distributed on the heat protection plate 14 along the circumference or the tangential direction and thus have approximately a 120° angular offset from one another.

Here, the lug 20*a* has a circular cutout 22 and a radially projecting lug extension 24 on the free end side. The lug 20*b* is provided with a circular screw opening 26. The lug 20*c* has—in a similar manner to the lug 20*a*—a radially projecting lug extension 24 on its free end.

The motor holder 8 has an axially projecting projection 28 in the region of the lug 20*a*. The approximately dome-shaped or stud-shaped or pin-shaped projection 28 tapers with a bevel on its free end side or is configured to be approximately conical or frustoconical. The projection 28 is integrally formed on the motor support 8. The motor holder 8 further has, in the region of the lug 20*b*, a threaded bore 30 into which a fastening screw (not shown more specifically) can be axially screwed. In the region of the lugs 20*a* and 20*c*, furthermore, two hook-shaped holding contours 32 are integrally formed on the motor holder 8. As can be seen in particular in FIG. 3, the hook contours 32 here radially project on an outer circumference of the motor holder 8.

Figure 4:
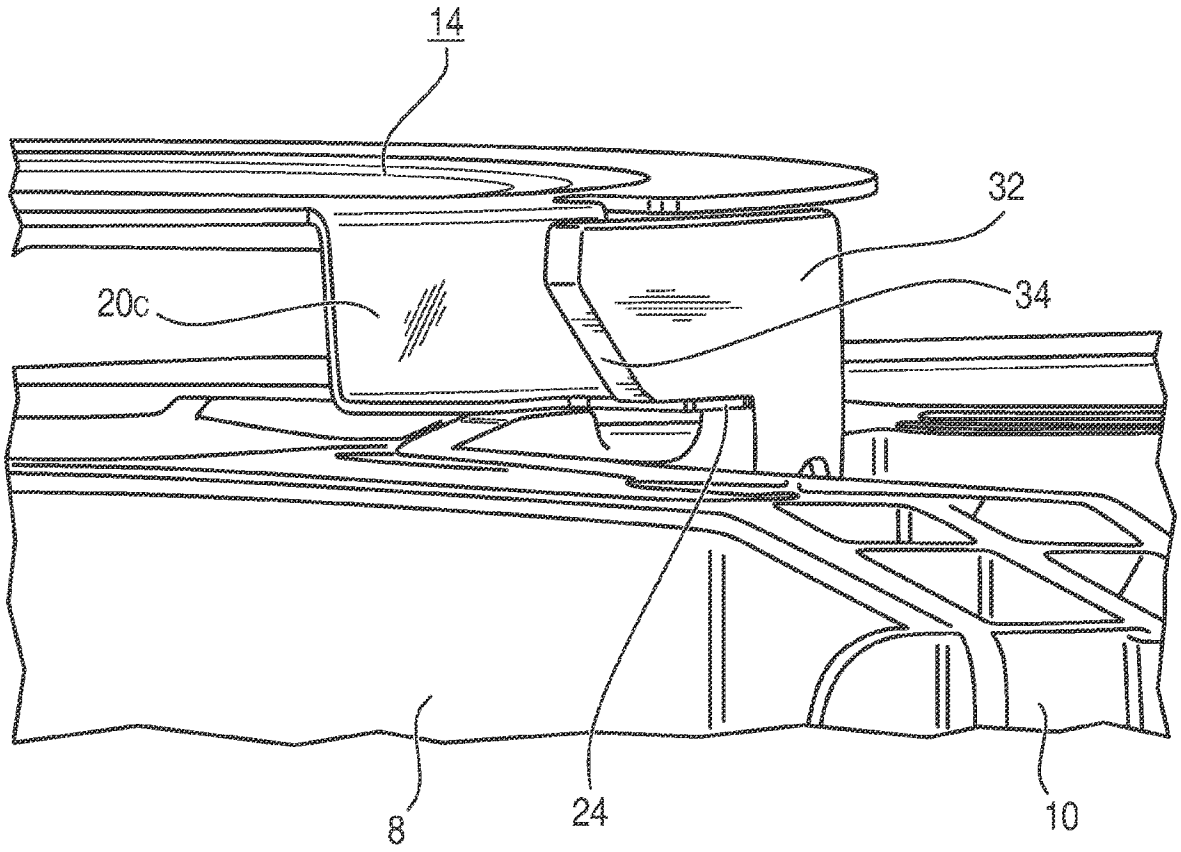
FIG. 4 is a perspective illustration showing a detail of a lug of the heat protection plate and a holding contour of the motor holder.

The mounting and fastening of the heat protection plate 14 on the motor holder 8 is explained in more detail below with reference to FIG. 2 to FIG. 4.

Figure 2:
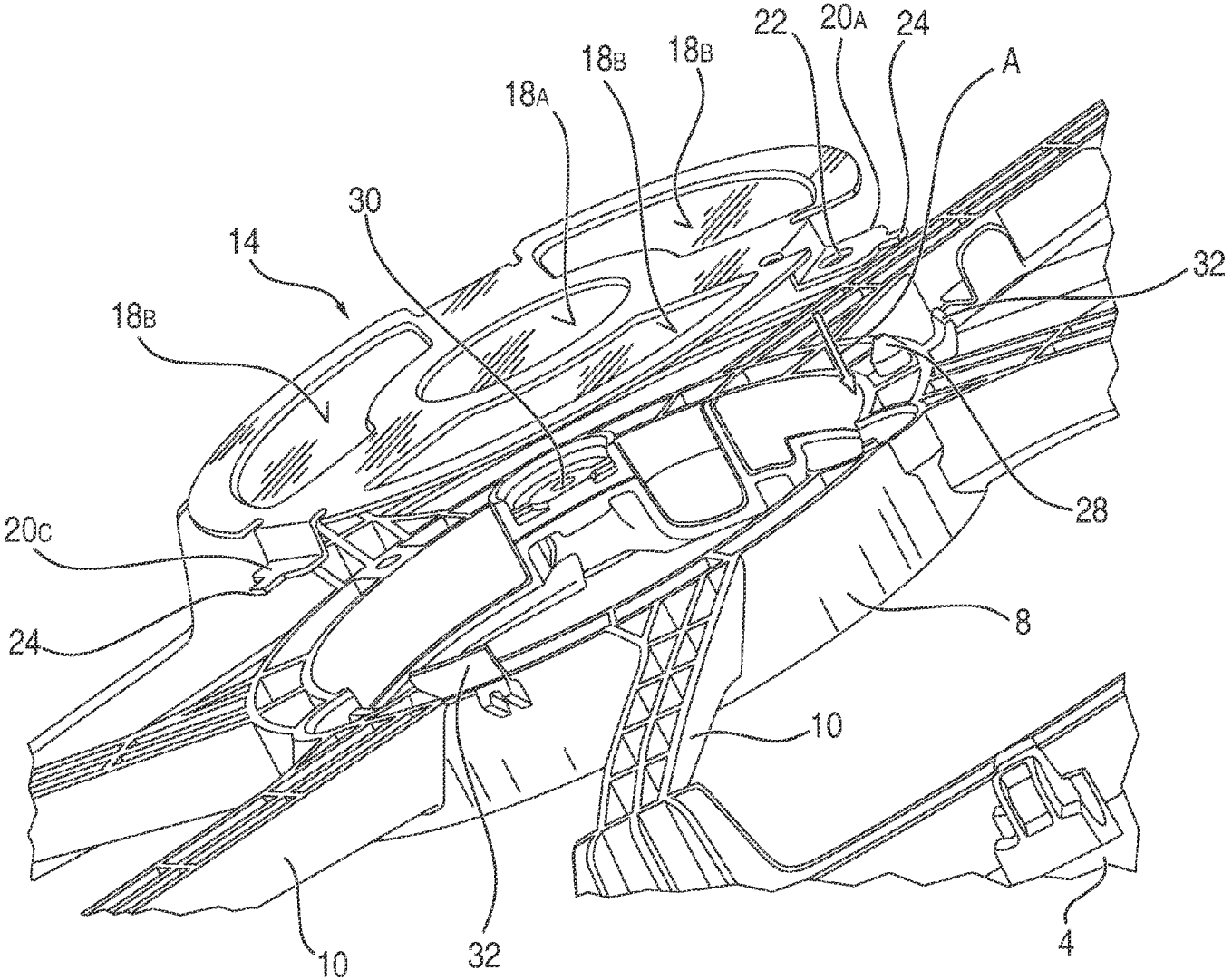
FIG. 2 is an exploded illustration showing the motor holder and the heat protection plate.

To fasten or mount the heat protection plate 14 on the motor holder 8, the heat protection plate 14 is—as shown in FIG. 2—placed onto the motor holder 8 along the axial direction A. Here, the lug 20*a* is placed or plugged with the cutout 22 onto the axial projection 28 of the motor holder 8.

The heat protection plate 14 is then, as shown in FIG. 3, pivoted about the projection 28, which acts as a pivot point or as an axis of rotation, along a screwing-in direction or pivoting direction B. As a result of the pivoting movement, the heat protection plate 14 is moved in a covering manner over the ring opening of the motor holder 8 or over the end side 16 of the electric motor 6. The pivoting or rotational movement causes the lugs 20*a* and 20*c* or their respective radial lug extensions 24 to be screwed into the holding contours 32 of the motor holder 8 in the manner of a bayonet connection and to be held by them in a form-fitting and/or force-fitting manner.

In the screwed-in state of the heat protection plate 14 that is shown in FIG. 1, the screw opening 26 of the lug 20*b* is arranged axially in alignment with the threaded bore 30 of the motor holder 8 such that the heat protection plate 14 can be screw-fastened axially to the motor holder 8. In the mounted state, the heat protection plate 14 is here fixed axially to the motor holder 8 in a force-fitting manner by means of a fastening screw (not shown more specifically).

When screwing the lug extensions 24 into the holding contours 32, the heat protection plate 14 is mechanically braced such that, in the screwed-in state, inner mechanical prestressing is imparted to the heat protection plate 14. For this purpose, the holding contours 32 have—as shown in FIG. 4—an axially inclined ramp guide 34 which runs along the tangential direction and on which the lug extensions 24 slide in the course of being screwed in or pivoted.

The ramp guide 34 is formed as an axial slope, that is to say as a surface inclined at an angle with respect to the axial direction A, of the holding contour 32. Here, the ramp guide A has, with respect to the heat protection plate 14, a downward axial profile, that is to say oriented away therefrom or toward the electric motor 6.

During screwing in, the heat protection plate 14 is the lug extensions 24 are guided along on the ramp guides 34, and thus moved axially in the direction of the electric motor 6. Consequently, the heat protection plate 14 is axially braced in certain portions, as a result of which the mechanical prestressing is imparted. Here, the heat protection plate 14 expediently has at least a certain degree of bending flexibility such that the heat protection plate 14 is held clamped or jammed by the ramp guide 34 when screwing into the holding contours 32.

As a result of the prestressing, the lug extensions 24, and hence the heat protection plate 14, are held in the holding contours 32 in a force-fitting manner. Furthermore, the approximately hook-shaped geometry of the holding contours 32 produces a form fit along the tangential direction and along the axial direction A.

The invention is not restricted to the exemplary embodiments described above. Rather, other variants of the invention may also be derived therefrom by a person skilled in the art without departing from the subject matter of the invention. In particular, furthermore, all of the individual features described in connection with the exemplary embodiments may also be combined with one another in some other way without departing from the subject matter of the invention.

LIST OF REFERENCE SIGNS

2 Radiator fan
4 Fan shroud
6 Electric motor
8 Motor holder
10 Strut
12 Fastening screw
14 Heat protection plate
16 End side
18*a*, 18*b* Depression
20*a*, 20*b*, 20*c* Lug
22 Cutout
24 Lug extension
26 Screw opening
28 Projection
30 Threaded bore
32 Holding contour
34 Ramp guide
A Axial direction
B Pivoting direction

The invention claimed is:

1. An electric-motor radiator fan of a motor vehicle, the radiator fan comprising:

a fan shroud with a motor holder, said motor holder being formed with at least one holding contour and with an axially protruding projection;

an electric motor inserted in said motor holder; and a heat protection plate arranged on an end side of said electric motor;

said heat protection plate being formed with a cutout for placement on said axially protruding projection of said motor holder; and said heat protection plate, with said axially protruding projection in said cutout, being pivotable about an axis of rotation defined by said axially protruding projection and said axis of rotation being parallel to an axis of rotation of the electric-motor, to rotate said heat protection plate, at least in certain portions thereof, into said at least one holding contour of said motor holder with at least one of a form-fit or a force-fit.

2. The radiator fan according to claim 1, wherein said at least one of a form-fit or force-fit is a bayonet connection.

3. The radiator fan according to claim 1, wherein said heat protection plate is mechanically prestressed upon being rotated into said holding contour.

4. The radiator fan according to claim 1, wherein, after having been rotated into said holding contour, said heat protection plate is force-fittingly fixed on said motor support by a single screw connection.

5. The radiator fan according to claim 1, wherein said at least one holding contour is configured as a hook and is arranged on said motor support in a tangential orientation.

6. The radiator fan according to claim 1, wherein said at least one holding contour is formed with a ramp guide, and said ramp guide is configured such that, when said heat protection plate is rotated into said at least one holding contour, said heat protection plate slides, at least in certain portions, axially on said ramp guide to produce inner mechanical prestressing.

7. The radiator fan according to claim 1, wherein said heat protection plate is formed with at least one radially directed and axially angled lug.

8. The radiator fan according to claim 7, wherein said at least one lug has a radially projecting lug extension which, upon a rotation of said heat protection plate, said lug extension is rotated into said holding contour.

9. The radiator fan according to claim 7, wherein:

said at least one lug is one of three circumferentially distributed lugs on said heat protection plate;

a first lug of said three lugs is formed with said cutout;

a second lug of said three lugs is formed with a screw opening for guiding through a fastening screw; and a third lug of said three lugs has a radial lug extension.

10. A heat protection plate for a radiator fan having a fan shroud with a motor holder the motor holder being formed with at least one holding contour and with an axially protruding projection, and an electric motor inserted in the motor holder, wherein the heat protection plate:

is configured to be arranged on an end side of the electric motor and is formed with a cutout to be placed on the axially protruding projection of the motor holder; and with the axially protruding projection being inserted in the cutout, being pivotable about an axis of rotation defined by the axially protruding projection and the axis of rotation being parallel to an axis of rotation of the electric-motor, to rotate the heat protection plate, at least in certain portions thereof, into the at least one holding contour of the motor holder with at least one of a form-fit or a force-fit.

* * * * *